US009873953B2

(12) United States Patent
Kamachi

(10) Patent No.: US 9,873,953 B2
(45) **Date of Patent: *Jan. 23, 2018**

(54) METHOD FOR REMOVING RARE EARTH IMPURITIES FROM NICKEL-ELECTROPLATING SOLUTION

(71) Applicant: HITACHI METALS, LTD., Minato-ku, Tokyo (JP)

(72) Inventor: Masanao Kamachi, Kumagaya (JP)

(73) Assignee: HITACHI METALS, LTD., Tokyo (JP)

( * ) Notice: Subject to any disclaimer, the term of this patent is extended or adjusted under 35 U.S.C. 154(b) by 65 days.

This patent is subject to a terminal disclaimer.

(21) Appl. No.: 14/771,327

(22) PCT Filed: Mar. 17, 2014

(86) PCT No.: PCT/JP2014/057107

§ 371 (c)(1),
(2) Date: Aug. 28, 2015

(87) PCT Pub. No.: WO2014/156761

PCT Pub. Date: Oct. 2, 2014

(65) Prior Publication Data

US 2016/0002814 A1 Jan. 7, 2016

(30) Foreign Application Priority Data

Mar. 25, 2013 (JP) ..... 2013-061648

(51) Int. Cl.
*C25D 21/18* (2006.01)
*C25D 21/06* (2006.01)
(Continued)

(52) U.S. Cl.
CPC ..... *C25D 21/18* (2013.01); *C25D 21/06* (2013.01); *C25D 21/10* (2013.01); *C25D 3/12* (2013.01)

(58) Field of Classification Search
CPC ..... C25D 21/18; C01F 17/0043
See application file for complete search history.

(56) References Cited

U.S. PATENT DOCUMENTS 3,653,813 A 4/1972 Chiola et al.
5,037,463 A 8/1991 Engdahl et al.
(Continued)

FOREIGN PATENT DOCUMENTS

CN 1678532 A 10/2005
CN 101484615 A 7/2009
(Continued)

OTHER PUBLICATIONS

Nakayama and Sakamoto, English Machine Translation, JP 2006-77271 A (2006).*
(Continued)

*Primary Examiner* — Bryan D. Ripa
*Assistant Examiner* — Ho-Sung Chung
(74) *Attorney, Agent, or Firm* — Sughrue Mion, PLLC

(57) ABSTRACT

A method for removing rare earth impurities from a nickel-electroplating solution by adding a rare earth compound to the nickel-electroplating solution containing rare earth impurities, keeping the electroplating solution at 60° C. or higher for a certain period of time, and then removing precipitate generated by the heating from the nickel-electroplating solution together with the added rare earth compound by sedimentation and/or filtration.

7 Claims, 3 Drawing Sheets

(51) Int. Cl.
*C25D 3/12* (2006.01)
*C25D 21/10* (2006.01)

(56) References Cited

U.S. PATENT DOCUMENTS

| | | | | |
|---|---|---|---|---|
| 7,887,603 | B2 | 2/2011 | Shindo et al. | |
| 8,152,864 | B2 | 4/2012 | Shindo et al. | |
| 2003/0226761 | A1 | 12/2003 | Featherstone et al. | |
| 2005/0232849 | A1* | 10/2005 | Shindo | C01G 3/10 423/557 |
| 2009/0078577 | A1 | 3/2009 | Suzuki et al. | |
| 2010/0108530 | A1* | 5/2010 | Zehnder | B82Y 30/00 205/205 |
| 2011/0033369 | A1 | 2/2011 | Shindo et al. | |
| 2011/0120267 | A1 | 5/2011 | Roche | |
| 2012/0309614 | A1 | 12/2012 | Ohtake et al. | |
| 2014/0224664 | A1 | 8/2014 | Kamachi | |
| 2016/0002815 | A1 | 1/2016 | Kamachi | |

FOREIGN PATENT DOCUMENTS

| | | | |
|---|---|---|---|
| JP | 61-533 | A | 1/1986 |
| JP | 2-209500 | A | 8/1990 |
| JP | 7-34300 | A | 2/1995 |
| JP | 7-62600 | A | 3/1995 |
| JP | 2002-194600 | A | 7/2002 |
| JP | 2006-77271 | A | 3/2006 |
| JP | 2008-45187 | A | 2/2008 |
| JP | 2013-173993 | A | 9/2013 |
| WO | 2013/047340 | A1 | 4/2013 |

OTHER PUBLICATIONS

Final Office Action dated Feb. 15, 2017, issued in corresponding U.S. Appl. No. 14/771,330, 11 pages.
Chinese Office Action dated Dec. 1, 2016 for Application No. 201480017713.7 filed Sep. 9, 2013, 13 pages total.
Chinese Office Action dated Sep. 6, 2015, for Application No. 201280048690.7; 10 pages total.
Chinese Office Action dated Dec. 1, 2016, for Application No. 201480017674.0, 13 pages total.
International Search Report for International Application No. PCT/JP2014/057136 dated Jun. 17, 2014; 5 pages.
Non-Final Office Action dated Oct. 19, 2016, issued in U.S. Appl. No. 14/771,330, 8 pages.
U.S. Non-Final Office Action dated Sep. 12, 2016, issued for corresponding U.S. Appl. No. 14/346,058; 15 pages total.
International Search Report for PCT/JP2014/057107 dated Jun. 17, 2014. [PCT/ISA/210].
Notice of Allowance and Notice of Allowability dated Jul. 12, 2017, in U.S. Appl. No. 14/771,330, 9 pages.
Communication dated Aug. 2, 2017 from the State Intellectual Property Office of the P.R.C. in counterpart Application No. 201480017713.7.
A Notice of Allowance dated Mar. 27, 2017, which issued during the prosecution of U.S. Appl. No. 14/346,058.
Linyan Li et al. "Recovery of Ni, Co and rare earths from spent Ni-metal hydride batteries and preparation of spherical $Ni(OH)_2$" Hydrometallurgy, vol. 100 (2009) (pp. 41-46).

* cited by examiner

METHOD FOR REMOVING RARE EARTH IMPURITIES FROM NICKEL-ELECTROPLATING SOLUTION

CROSS REFERENCE TO RELATED APPLICATIONS

This application is a National Stage of International Application No. PCT/JP2014/057107 filed Mar. 17, 2014 (claiming priority based on Japanese Patent Application No. 2013-061648, filed Mar. 25, 2013), the contents of which are incorporated herein by reference in their entirety.

FIELD OF THE INVENTION

The present invention relates to a method for removing rare earth impurities from a nickel-electroplating solution efficiently and easily.

BACKGROUND OF THE INVENTION

Rare earth magnets, particularly sintered R—Fe—B magnets (R is at least one of rare earth elements including Y, indispensably containing Nd), are widely used because of high magnetic properties, but Nd and Fe contained as main components are rusted very easily. To improve their corrosion resistance, the magnets are provided with corrosion-resistant coatings. Among them, a nickel electroplating is widely used for these magnets, because it has high hardness and is easier than electroless plating in controlling plating steps.

In the earliest growing stage of the electroplated nickel layer, components in an article to be plated may be dissolved in a plating solution. Particularly when the plating solution has pH on the acidic side, the article to be plated is easily dissolved and accumulated as impurities in the plating solution.

In the case of the sintered R—Fe—B magnets, rare earth elements such as Nd, and Fe, main components, are dissolved in the plating solution as impurities. As a result of continuous plating, rare earth impurities such as Nd, and Fe, main components of the magnets, are dissolved and accumulated in the plating solution. To conduct plating without impurities, a new plating solution should be used in every plating treatment. However, the preparation of a new plating solution in each plating treatment is substantially impossible because of production cost increase.

When the plating solution contains impurities, a nickel electroplating generally tends to suffer deteriorated gloss, insufficient adhesion to an article to be plated, burnt deposits, etc. For example, when a certain level or more of rare earth elements are accumulated as impurities in the plating solution, the resultant plating has low adhesion to a magnet body, thereby suffering peeling, and double plating (interfacial delamination) caused by intermittent current during plating.

Whether or not defects such as decreased adhesion and double plating occur depends on the composition of a plating solution, plating conditions, etc., and the inventor's experiment has revealed that when the amount of rare earth impurities (mainly Nd impurity) exceeds 700 ppm, these defects likely occur. Particularly, in barrel-type plating, the double plating likely occurs because large current locally flows through an article to be plated.

When nickel electroplating is carried out in an industrial mass production scale, it is impractical from the aspect of production cost to keep a nickel-electroplating solution completely free from rare earth impurities, so that it is in general not used. However, it is desirable for quality control to limit the amount of rare earth impurities as small as not exceeding 700 ppm.

Generally conducted to remove impurities such as Fe from the nickel-electroplating solution are, (1) a method of adding a nickel compound such as nickel carbonate, etc. to a plating solution to increase its pH (activated carbon may be added simultaneously to remove organic impurities), precipitating impurities by air stirring, and then removing the impurities by filtration; and (2) a method of immersing an iron net or plate in the plating solution, and conducting cathodic electrolysis at a low current density. Though these methods are effective to remove iron and organic impurities dissolved in the nickel-electroplating solution, they are not effective to remove rare earth impurities.

JP 7-62600 A discloses a method for removing rare earth impurities from a nickel-electroplating solution, with an agent used for the purification and separation of rare earth metals. This method appears to be effective as one of methods for reducing the amounts of rare earth impurities in the nickel-electroplating solution. However, this method inefficiently needs complicated steps, and impractically needs a special agent.

OBJECT OF THE INVENTION

Accordingly, an object of the present invention is to provide a method for removing rare earth impurities from a nickel-electroplating solution relatively easily and efficiently, without using complicated steps, and without needing a special agent.

DISCLOSURE OF THE INVENTION

As a result of intensive research in view of the above object, the inventor has found that by adding a rare earth compound to a nickel-electroplating solution containing rare earth impurities and keeping the plating solution at 60° C. or higher for a certain period of time, the rare earth impurities can be precipitated, and easily removed by filtration. The present invention has been completed based on such finding.

The method of the present invention for removing rare earth impurities from a nickel-electroplating solution comprises adding a rare earth compound to a nickel-electroplating solution containing rare earth impurities;

keeping the plating solution at 60° C. or higher for a certain period of time; and then removing a precipitate generated by the heating from the nickel-electroplating solution, together with the added rare earth compound by sedimentation and/or filtration.

The rare earth compound is preferably a rare earth oxide.

A rare earth element constituting the rare earth compound is preferably neodymium.

The nickel-electroplating solution is preferably stirred while heating.

The stirring of the solution is preferably achieved by air, rotating stirring blades, or circulation by a pump.

DESCRIPTION OF THE PREFERRED EMBODIMENTS

Figure 1:
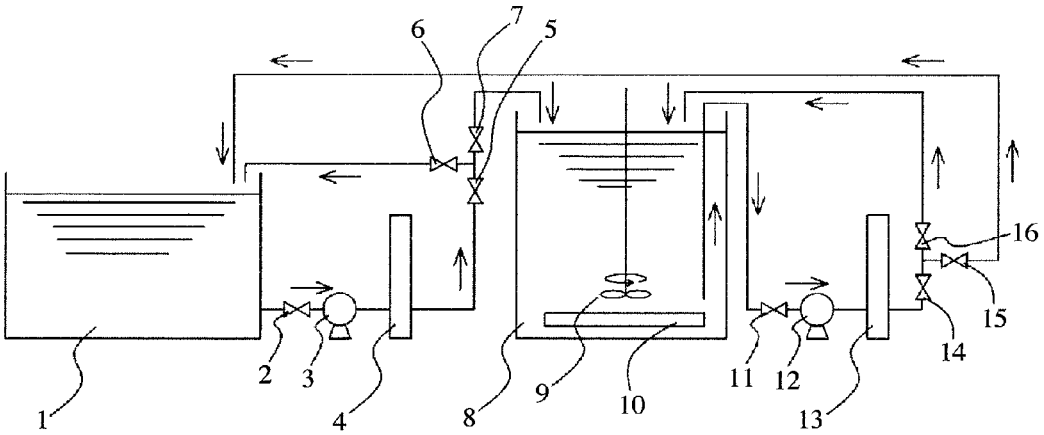
FIG. 1 is a schematic view showing an example of nickel-electroplating apparatuses for carrying out the method of the present invention for removing rare earth impurities from a nickel-electroplating solution.

The method of the present invention for removing rare earth impurities from a nickel-electroplating solution comprises adding a rare earth compound to the nickel-electroplating solution containing rare earth impurities; keeping the plating solution at 60° C. or higher for a certain period of time; and then removing the resultant precipitate and the rare earth compound from the nickel-electroplating solution by sedimentation and/or filtration.

In the present invention, the rare earth impurities are R components dissolved in an electroplating solution, for example, when a sintered R—Fe—B magnet (R is at least one rare earth element including Y, indispensably containing Nd) is electroplated with nickel. Because the rare earth impurities are in the form of ions in the plating solution, they are not easily collected by filtration as they are. The present invention turns rare earth impurities in the form of ions to a solid precipitate collectable by a filtering equipment, which can be removed from the plating solution by sedimentation or filtration. It should be noted that the present invention is not restricted to the removal of an R component dissolved in the plating solution when the sintered R—Fe—B magnet is electroplated with nickel, but may be applied to the removal of rare earth impurities existing in the form of ions in the plating solution in advance.

Though the relation between the amount of rare earth impurities (particularly Nd impurity) and double plating and peeling in the resultant plating film may vary depending on plating conditions, these phenomena do not occur when the amount of the Nd impurity is about 200 ppm. To reduce the amount of the Nd impurity to 200 ppm or less, a rare-earth-impurity-decreasing treatment can be conducted with the following temperature and time.

At the time of removing rare earth impurities, the plating solution should be heated to 60° C. or higher. At lower than 60° C., it takes too much time to remove rare earth impurities, not suitable for industrial production. A higher solution temperature tends to provide a higher efficiency of removing rare earth impurities (precipitate). Though not particularly restrictive, the upper limit of the solution temperature is desirably lower than the boiling point of the plating solution, taking into consideration operability and safety, as well as influence on the composition of the plating solution, etc.

When the plating solution is heated to its boiling point or higher, water is rapidly evaporated from the plating solution, resulting in the rapid precipitation of components in the plating solution. The boiling point of the plating solution may vary depending on its composition, and for example, the boiling point of a Watts bath is about 102° C. Because the boiling point of the plating solution is elevated as its molar boiling point is elevated, the boiling points of any plating solutions having different compositions can be controlled in the removal of impurities, with 100° C. as their upper limits, the boiling point of water. Thus, in the method of the present invention, heating is preferably in a range of 60° C. to 100° C., more preferably in a range of 70° C. to 95° C., most preferably in a range of 80° C. to 90° C.

Though variable depending on the temperature, the treatment time is preferably 6 hours or more, more preferably 12 hours or more. Though not particularly necessary, the upper limit of the treatment time is preferably 168 hours or less, more preferably 72 hours or less, most preferably 24 hours or less, from the aspect of cost and operation efficiency.

The relation between the amount of rare earth impurities (particularly Nd impurity) and the occurrence of double plating and the peeling of a plating film may vary depending on the plating conditions, but such problems do not occur when the amount of Nd impurity is about 200 ppm. Accordingly, the above temperature and time are properly set to reduce the amount of Nd impurity to 200 ppm or less.

However, a longer heating time (keeping time) needs more preliminary baths for removing impurities from the plating solution. Accordingly, when there is a facility capable of heating the plating solution to 90° C. or higher, the amount of the impurity can be reduced to 100 ppm or less in 24-48 hours.

Because a bath used in the method of the present invention for removing rare earth impurities should have high heat resistance in the above heating range (heating temperature of the plating solution), a higher heating temperature inevitably results in a higher cost. Carrying out the method in the above temperature range, particularly in the preferable temperature range contributes to the suppression of cost increase.

Known rare earth compounds may be added. As the rare earth compounds, rare earth oxides may be neodymium oxide, dysprosium oxide, terbium oxide, praseodymium oxide, etc. Particularly, a rare earth element constituting these compounds is preferably neodymium, a main component of the sintered R-T-B magnets. It is preferable to use neodymium oxide.

Rare earth hydroxides obtained by hydroxidizing rare earth oxides may also be used. As the rare earth compounds, rare earth salts such as rare earth chlorides, rare earth sulfates, etc. may also be used. As the rare earth hydroxides and rare earth salts, neodymium hydroxide, neodymium chloride, neodymium sulfate, etc. are preferable. Neodymium chloride and neodymium sulfate may be in the form of hydrates.

Why the precipitation of rare earth impurities is accelerated in the present invention by adding a rare earth compound while the nickel-electroplating solution containing rare earth impurities is heated is not known, but it may be presumed that the rare earth compound acts as nuclei for the precipitation of rare earth impurities in the nickel-electroplating solution.

The rare earth compounds acting as nuclei include rare earth oxides, rare earth hydroxides, rare earth salts, rare earth sulfates, etc. Particularly the rare earth oxides are suitable because they are relatively easily available. These compounds may be added in the form of powder, or after stirred in water. Alternatively, they may be added to an aqueous acid solution and then charged into the plating solution.

The rare earth compound may be added before heating the nickel-electroplating solution containing rare earth impurities, or before or after reaching a predetermined temperature during heating. With the rare earth compound added to the nickel-electroplating solution containing rare earth impurities, the feature of the present invention can be achieved by keeping the temperature at 60° C. or higher for a certain period of time.

In the present invention, the rare earth compound to be added may be in a different form from that of the rare earth compound removed with impurities.

When the method of the present invention for removing rare earth impurities is carried out, the concentration of the plating solution is desirably 1-3 times that of the plating solution when plating is conducted. The plating solution is desirably concentrated by heating. Because water (solvent) is evaporated from the plating solution by heating, heating and concentrating can be conducted simultaneously.

When the plating solution is concentrated by heating, a higher temperature within a heating temperature range preferable in the present invention can preferably shorten a necessary concentrating time. When the plating solution is concentrated more than 3 times by heating, components start to be precipitated in the plating solution undesirably rapidly. The concentration is more preferably 1-2 times. Though the treatment can be conducted even with a concentration of 2-3 times, control should be carefully conducted to avoid the start of precipitation of plating solution components, when the concentration is near 3 times.

Because heating reduces the amount of the plating solution by the evaporation of water, water should be supplemented to keep the amount of the plating solution constant. For example, when a heater is exposed from a surface of the plating solution lowering by concentration, the heater may be broken. In such case, water is desirably supplemented to keep a constant concentration. With the concentration of the plating solution kept constant, for example, a plating solution sent to a plating bath after rare earth impurities are removed in a preliminary bath needs only a short period of time for concentration adjustment by supplementing water.

The present invention is suitable for removing rare earth impurities from an acidic to neutral nickel-plating solution. The present invention is applicable to such nickel-plating solutions as a Watts bath, a high-chloride bath, a chloride bath, a sulfamic acid bath, etc., and it is most suitable for the Watts bath. The Watts bath may have a general composition. For example, it is applicable to a composition comprising 200-320 g/L of nickel sulfate, 40-50 g/L of nickel chloride, and 30-45 g/L of boric acid, as well as a glossing agent and a pit inhibitor as additives.

The composition adjustment of the plating solution uses a known analysis method (titration analysis, etc.). For example, in the case of a Watts bath, the amounts of nickel chloride and the entire nickel are analyzed by titration to determine the amount of nickel sulfate, and the amount of boric acid is analyzed by titration.

In the present invention, the composition of the plating solution is adjusted by supplementing nickel sulfate, nickel chloride, and boric acid, when they are insufficient in the plating solution after removing rare earth impurities. When these agents are added, the plating solution is desirably heated to a temperature at which plating is conducted. At a low temperature, the agents added are not or too slowly dissolved. After composition adjustment, the pH is adjusted by nickel carbonate or sulfuric acid, and known glossing agent and pit inhibitor are added for plating treatment.

Plating conditions using the plating solution of the present invention may be properly changed, depending on the plating facility, the plating method, the size and number of articles to be plated, etc. For example, when a Watts plating bath having the above composition is used, plating conditions are preferably pH of 3.8-4.5, a bath temperature of 45-55° C., and a current density of 0.1-10 A/dm$^2$. The plating method may be rack-type or barrel-type, and may be properly set depending on the size and number of articles to be plated.

According to the present invention, a plating bath formed by FRP or PP having high heat resistance, or a fluororesin-coated iron plate can remove impurities from the nickel-electroplating solution without using a preliminary bath. Impurities can be removed in a preliminary bath formed by a material having high heat resistance, and plating can be conducted in a plating bath formed by polyvinyl chloride (PVC), resulting in improved efficiency and operability. Containers formed by a material having high heat resistance can be used for both plating bath and preliminary bath, for improved safety.

A system comprising a plating bath and a preliminary bath for removing rare earth impurities will be explained below referring to FIG. 1. The plating bath 1 comprising an anode plate (not shown), a cathode plate (not shown), a heater (not shown) and a stirrer (not shown) can form a plating solution to carry out nickel electroplating. Though variable depending on the plating solution, a material for the plating bath 1 is preferably polyvinyl chloride (PVC) or heat-resistant polyvinyl chloride (PVC).

A first filtration system is constituted by a plating bath 1, valves 2, 5, 6, 7, a pump 3, and a filtering equipment 4. With the valve 7 closed, and the valves 2, 5, 6 open, the pump 3 is operated to circulate a plating solution in the plating bath 1 through the filtering equipment 4 for filtration. Namely, the plating solution is circulated through the plating bath 1, the valve 2, the pump 3, the filtering equipment 4, the valve 5, and the valve 6, and filtered by the filtering equipment 4. The filtering equipment 4 may use a known filter for electroplating, and may be integrally combined with the pump 3. A pipe material is preferably polyvinyl chloride (PVC) or heat-resistant polyvinyl chloride (PVC).

The preliminary bath 8 comprises stirring blades 9 connected to a motor (not shown), and a heater 10 connected to a power supply (not shown). The heater 10 may also be a steam heater connected to a vapor-generating apparatus through a pipe. Other than the stirring blades 9, a means of stirring the plating solution in the preliminary bath may be an air-bubbling pipe connected to an air pump, or circulation by a pump 12 as described below. To treat a high-temperature plating solution containing rare earth impurities, the preliminary bath 8 is preferably formed by PP or FRP having high heat resistance.

A second filtration system is constituted by the preliminary bath 8, valves 11, 14, 15, 16, a pump 12, and a filtering equipment 13. The filtering equipment 13 may be integrally combined with the pump 12.

The circulation of the plating solution through the preliminary bath, and the supply of the plating solution from the preliminary bath to the plating bath will be explained below.

With the valve 6 closed, and the valves 2, 5, 7 open, the pump 3 is operated to circulate the plating solution from the plating bath 1 to the preliminary bath 8 through the filtering equipment 4. Namely, the plating solution is circulated through the plating bath 1, the valve 2, the pump 3, the filtering equipment 4, the valve 5, the valve 7, and the preliminary bath 8.

With the valve 15 closed, and the valves 11, 14, 16 open, the pump 12 is operated to circulate the plating solution in the preliminary bath 8 through the filtering equipment 13 for filtration. Namely, the plating solution is circulated through the preliminary bath 8, the valve 11, the pump 12, the filtering equipment 13, the valve 14, the valve 16, and the preliminary bath 8, and filtered by the filtering equipment 13.

With the valve 16 closed, and the valves 11, 14, 15 open, the pump 12 is operated to circulate the plating solution from the preliminary bath 8 to the plating bath 1 via the filtering equipment 13. Namely, the plating solution is supplied from the preliminary bath 8 to the plating bath 1, through the valve 11, the pump 12, the filtering equipment 13, the valve 14, and the valve 15.

A rare earth compound is added to the preliminary bath 8, and then a heating treatment is carried out to precipitate rare earth impurities. The precipitated rare earth impurities and the added rare earth compound are sedimented on a bottom of the preliminary bath 8, when stirring by the stirring blades 9 is stopped. After the added rare earth compound and the precipitate are sedimented, the plating solution is sent from the preliminary bath 8 to the plating bath 1 through the valve 11, the pump 12, the filtering equipment 13, the valve 14, and the valve 15, thereby suppressing the clogging of the filter in the filtering equipment 13 with the added rare earth compound and the precipitate to use the filter for a long period of time.

Because a tip end (sucking the plating solution) of a pipe connecting the preliminary bath 8 to the pump 12 via the valve 11 is not in contact with a bottom of the preliminary bath 8, the added rare earth compound and the precipitate accumulated on the bottom are substantially not sucked.

When the plating solution containing the added rare earth compound and the precipitate generated by heating is quickly sent to the plating bath 1, it is unnecessary to wait sedimentation.

When the plating solution after sedimenting the rare earth compound and the precipitate is sent from the preliminary bath 8 to the plating bath 1, the filtering equipment 13 may not be provided with a filter. The sufficiently sedimented rare earth compound and precipitate are accumulated on the bottom of the preliminary bath 8, so that the plating solution sent from the preliminary bath 8 to the plating bath 1 contains extremely small amounts of the rare earth compound and the precipitate. Accordingly, after sent to plating bath 1, the remaining rare earth compound and precipitate can be removed from the plating solution, in the filtration step of the plating solution in the plating bath 1 through a path comprising the plating bath 1, the valve 2, the pump 3, the filtering equipment 4, the valve 5 and the valve 6.

The present invention can be carried out not only by the above apparatus, but also by apparatuses having various structures. For example, a pipe for circulating the plating solution in the plating bath 1, and a pipe for sending the plating solution from the plating bath 1 to the preliminary bath 8 may be independently provided. A specific structure comprising valves, a pump and a filtering equipment connected to the plating bath 1 will be explained below.

As described above, with the valve 7 closed, and the valves 2, 5, 6 open, the pump 3 is operated to circulate the plating solution through the plating bath 1, the valve 2, the pump 3, the filtering equipment 4, the valve 5, and the valve 6. With the valve 6 closed, and the valves 2, 5, 7 open, the pump 3 is operated to send the plating solution from the plating bath 1 to the preliminary bath 8, through the valve 2, the pump 3, the filtering equipment 4, the valve 5, and the valve 7. By opening and closing the valves 5, 6, 7, circulation through the plating bath 1 and supply from the plating bath 1 to the preliminary bath 8 are switched. In this case, a path through the valve 2, the pump 3, the filtering equipment 4 and the valve 5 is commonly used in circulation and supply.

The above common portions may be independent. One pipe for circulation passes through the valve 2, the pump 3, the filtering equipment 4, the valve 5, the valve 6, and the plating bath 1 (the valves 5 and 6 are not indispensable), and another pipe passes through the valve 2', the pump 3', the filtering equipment 4', the valve 5', the valve 7, and the preliminary bath 8 (the valve 5' and 7 are not indispensable). With such structure, the circulation and supply of the plating solution can be conducted through simple paths, avoiding the malfunctions of the valves, etc. In the pipe for circulating the plating solution through the preliminary bath 8, and the pipe for supplying the plating solution from the preliminary bath 8 to the plating bath 1, common portions may be similarly independent to obtain the same effects as described above.

Figure 2:
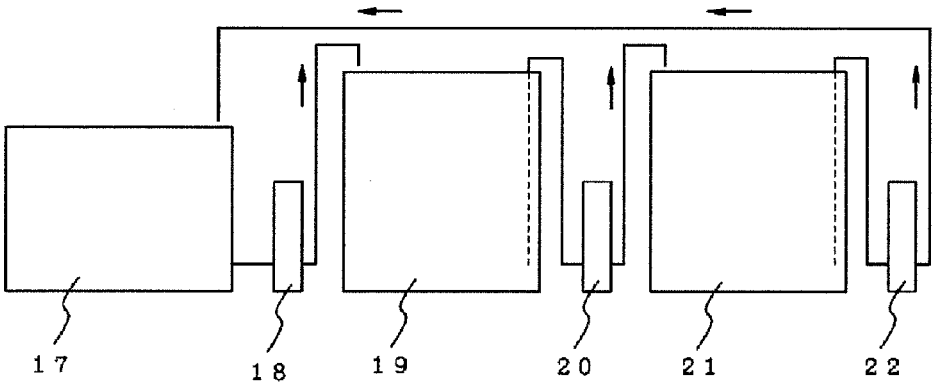
FIG. 2 is a schematic view showing another example of nickel-electroplating apparatuses for carrying out the method of the present invention for removing rare earth impurities from a nickel-electroplating solution.

FIG. 2 shows a structure comprising another preliminary bath added to the system of shown in FIG. 1, which comprises a plating bath and a preliminary bath. In FIG. 2 mainly explaining the functions of the plating bath and the preliminary bath, a heater and stirring blades in each preliminary bath, and electrodes, etc. in the plating bath are not shown. Only pipes for supplying the plating solution between the preliminary baths and between these preliminary baths and the plating bath are shown, with valves and circulation pipes omitted.

The rare earth compound may be added to the nickel-electroplating solution containing rare earth impurities in a first preliminary bath 19 and/or a second preliminary bath 21. Each preliminary bath having a heater (and stirring blades) can heat the nickel-electroplating solution to accelerate the precipitation of rare earth impurities. For example, the nickel-electroplating solution containing rare earth impurities sent to the first preliminary bath 19 is heated with the rare earth compound added, to precipitate the rare earth impurities and the added rare earth compound, filtered to remove them by a filtering equipment (and pump) 20, and then sent to the second preliminary bath 21. In this method, with a nickel-electroplating solution containing a reduced amount of rare earth impurities prepared in the second preliminary bath in advance, and sent to the plating bath 17, a plating-waiting time in the plating bath 17 can be shortened.

By the same method, after removing rare earth impurities by half of the target amount, the nickel-electroplating solution may be sent to the second preliminary bath 21, to which the rare earth compound is added and heated to precipitate rare earth impurities, and then filtered by a filtering equipment (and pump) 22 to remove the rare earth impurities.

Such method can conduct a multi-stage removal of rare earth impurities, making it possible to set the amount of rare earth impurities removed depending on the treatment capacity of each preliminary bath 19, 21, resulting in improved practical use on an industrial scale.

In the present invention, after the precipitated rare earth impurities and the rare earth compound are separated from the nickel-electroplating solution, or when the nickel-electroplating solution is sent to the plating bath simultaneously with filtration by the filtering equipment, the nickel-electroplating solution is desirably cooled to a temperature equal to or lower than its treatment temperature. When the sent nickel-electroplating solution is at a higher temperature than its treatment temperature, a nickel film electroplated at such a temperature may have deteriorated properties. Because a nickel-electroplating bath usually comprises a heating means such as a heater, etc., the sent nickel-electroplating solution can be adjusted to have a treatment temperature by heating even though its temperature is lower than the treatment temperature. However, when the nickel-electroplating solution is at a higher temperature than the treatment temperature, a cooling means should be added to the plating bath, resulting in cost increase, and cooling time is needed, resulting in decreased plating efficiency. When the plating bath is made of a material having low heat resistance, it may be deformed by a high-temperature plating solution. The nickel-electroplating solution may be spontaneously cooled, after heating for the precipitation of rare earth impurities is stopped. For rapid cooling, a heat exchanger for cooling or a chiller may be used.

The present invention will be explained in more detail by Examples below without intention of restricting the scope of the present invention. Reference Examples 1-12 below are those conducted in the course of carrying out Example 1 of the present invention, which comprise heating a nickel-electroplating solution containing rare earth impurities for a certain period of time, to remove the precipitated rare earth impurities from the nickel-electroplating solution by sedimentation and/or filtration.

Reference Example 1

A plating solution having a composition comprising 250 g/L of nickel sulfate, 50 g/L of nickel chloride, and 45 g/L of boric acid, and having pH of 4.5 was heated to 50° C., to carry out nickel electroplating on several types of sintered R—Fe—B magnets, which were adjusted to have compositions comprising 15-25% by mass of Nd, 4-7% by mass of Pr, 0-10% by mass of Dy, 0.6-1.8% by mass of B, and 0.07-1.2% by mass of Al, the balance being Fe (containing 3% or less by mass of Cu and Ga), depending on necessary magnetic properties. Magnets having the same composition were used in each batch. The composition and amount of rare earth impurities dissolved in the plating solution may vary depending on the magnets to be plated, treatment methods such as barrel plating and rack plating, and the composition of the plating solution.

After plating for several days, Nd, Pr and Dy as impurities in the nickel-electroplating solution were analyzed by an ICP atomic emission spectrometer. Analysis indicates that the used plating solution contained 500 ppm of Nd, 179 ppm of Pr, and 29 ppm of Dy.

A certain amount (3 liters) of a plating solution containing the above rare earth impurities was charged into a beaker, and kept at 90° C. by a heater for a certain period of time. During heating, water was supplemented while stirring with a magnet stirrer, to keep the concentration of the plating solution constant.

After 24 hours and 96 hours passed, each plating solution in a necessary amount for ICP atomic emission spectroscopy was filtered by a filter paper, and the concentrations of Nd, Pr and Dy in the plating solution were measured by an ICP atomic emission spectrometer. Analysis results were 100 ppm of Nd, 35 ppm of Pr, and 16 ppm of Dy after 24 hours, and 50 ppm of Nd, 16 ppm of Pr, and 2 ppm of Dy after 96 hours.

As described above, rare earth impurities dissolved in the form of ions in a nickel-electroplating solution were turned to precipitates by heating for a predetermined period of time, and removed from the plating solution by filtration with a filter paper. Rare earth impurities which were not turned to precipitates by heating for a predetermined period of time remained in the plating solution in the form of ions in proportions shown by the above analysis. The above analysis indicates that a longer heating time provided more rare earth impurities removed as precipitates, and less rare earth impurities remaining in the form of ions in the plating solution. The treatment of Reference Example 1 decreased not only Nd but also Pr and Dy as rare earth impurities.

Reference Example 2

A plating solution having a composition comprising 250 g/L of nickel sulfate, 50 g/L of nickel chloride and 45 g/L of boric acid, and having pH of 4.5 was heated to 50° C., to carry out nickel electroplating on sintered R—Fe—B magnets in the same composition range as in Reference Example 1. In analysis after plating for several days, the amount of Nd impurity in the nickel-electroplating solution was 576 ppm.

Figure 3:
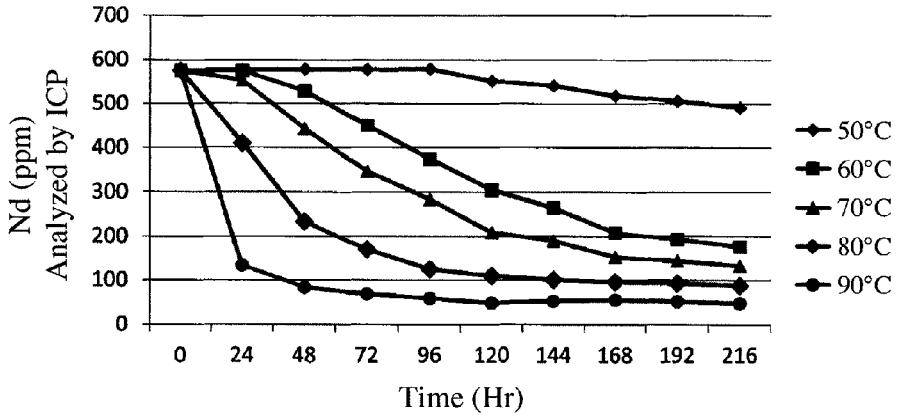
FIG. 3 is a graph showing the amount of Nd as a rare earth impurity in the filtered plating solution, which was measured by an ICP atomic emission spectrometer, and plotted against time at each keeping temperature.

After the above plating treatment for several days, the plating solution was heated under six conditions from 50° C. to 95° C. (five conditions between 50° C. and 90° C. by 10° C. interval), and 3 liters of a plating solution under each condition was kept in a beaker. The plating solution was stirred with a magnet stirrer, while heating. During heating, water was supplemented to keep the concentration of the plating solution constant, and each plating solution in a necessary amount for ICP atomic emission spectroscopy was taken with a constant interval, and filtered with a filter paper to remove precipitates. The filtered plating solution was analyzed with respect to the concentration of Nd impurity by an ICP atomic emission spectrometer. The analysis results from 50° C. to 90° C. are shown in Table 1 and FIG. 3.

TABLE 1

| Temperature of Solution | Amount (ppm) of Nd Impurity at Each Lapsed Time | | | | |
|---|---|---|---|---|---|
| | 0 hr | 24 hr | 48 hr | 72 hr | 96 hr |
| 50° C. | 576 | 578 | 579 | 578 | 579 |
| 60° C. | 576 | 575 | 529 | 450 | 374 |
| 70° C. | 576 | 553 | 443 | 346 | 284 |
| 80° C. | 576 | 410 | 234 | 170 | 125 |
| 90° C. | 576 | 134 | 84 | 69 | 59 |
| 95° C. | 576 | 130 | — | — | 52 |

| Temperature of Solution | Amount (ppm) of Nd Impurity at Each Lapsed Time | | | | |
|---|---|---|---|---|---|
| | 120 hr | 144 hr | 168 hr | 192 hr | 216 hr |
| 50° C. | 552 | 541 | 518 | 506 | 491 |
| 60° C. | 305 | 265 | 208 | 193 | 177 |
| 70° C. | 209 | 190 | 153 | 144 | 133 |
| 80° C. | 110 | 101 | 96 | 93 | 88 |
| 90° C. | 49 | 53 | 56 | 52 | 48 |
| 95° C. | — | — | — | — | — |

When the solution temperature was 50° C., the concentration of Nd impurity was 518 ppm after 168 hours. At the solution temperature of 60° C., the concentration of Nd impurity lowered after 24 hours, and became 177 ppm after 216 hours. The concentration of Nd impurity was always lower at the solution temperature of 70° C. than at 60° C., after 24 hours. At the solution temperature of 80° C., the concentration of Nd impurity was lowered immediately after heating, and became 125 ppm after 96 hours. At the solution temperature of 90° C., the concentration of Nd impurity was lowered to 134 ppm after 24 hours, 84 ppm after 48 hours, and 59 ppm after 96 hours. Analysis after 24 hours and 96 hours revealed that the concentration of Nd impurity did not substantially change at the solution temperatures of 90° C. and 95° C.

The above results revealed that in the plating solution heated to 60° C. or higher for a certain period of time, and then filtered to remove precipitates, the amount of Nd impurity was reduced, and that a higher heating temperature provided larger reducing effects.

When the amount of Nd impurity is to be reduced to 200 ppm or less, at which double plating and the peeling of a plating film do not occur, it has been found that it is reduced to about 200 ppm in a week (168 hours) at a heating temperature of 60° C., and that substantially the same effects are obtained in 5 days (120 hours) at 70° C., in 3 days (72 hours) at 80° C., and in 24 hours (one day) at 90° C. and 95° C. Accordingly, for example, with one week as a unit production period, a plating solution kept at 60° C. for a week (168 hours) and then filtered is fully usable for plating, and the amount of the impurity can be reduced to a plating-enabling level in 5 days (120 hours) at 70° C. Similarly, at 80° C., 90° C. and 95° C., the amounts of impurities in the plating solution can be reduced in a shorter period of time. Namely, the heating temperature and the keeping time can be selected depending on the presence of a facility of heating the plating solution to the above temperature, and a production schedule.

Reference Example 3

The plating solution heat-treated in Reference Examples 1 and 2 was filtered with a filter paper to obtain a precipitate, which was dried in a thermostatic chamber. Energy-dispersive X-ray spectroscopy (EDX) revealed that this precipitate in the form of powder (solid) had a composition comprising by mass 32.532% of Nd, 11.967% of Pr, 1.581% of Dy, 0.402% of Al, 7.986% of Ni, 0.319% of C, and 45.213% of O. It was confirmed from this result that rare earth impurities in the plating solution were precipitated in the form of powder (solid) by the heat treatment.

Reference Example 4

1 g/L of the precipitate collected in Reference Example 3 was added to the plating solution used in plating for several days in Reference Example 2, which contained rare earth impurities, the concentration of Nd impurity being 576 ppm. The precipitate-added plating solution was dispensed 3 liters each to beakers, and kept at 60° C. and 70° C., respectively, while stirring as in Reference Example 1. The plating solution free from the above precipitate was also dispensed 3 liters each to beakers, and kept at 60° C. and 70° C., respectively, while similarly stirring. Regardless of whether or not the above precipitate was added, water was supplemented during heating, to keep the concentration of the plating solution constant.

Figure 4:
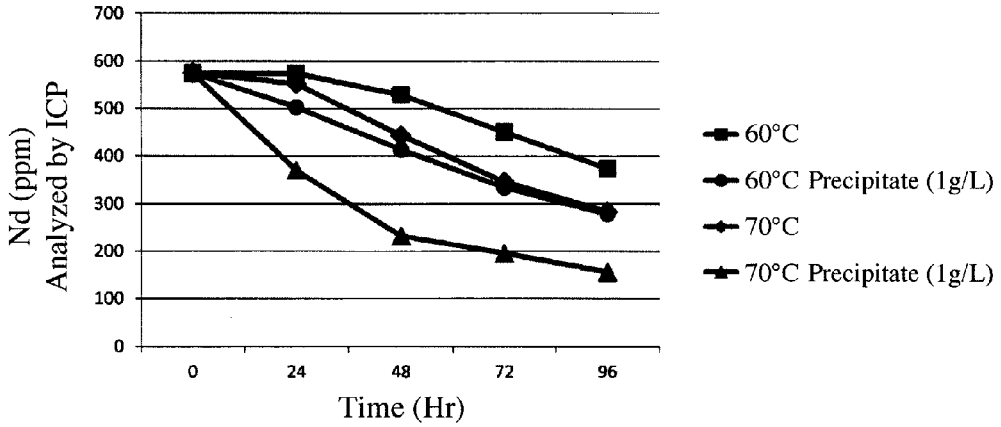
FIG. 4 is a graph showing the amount of Nd as a rare earth impurity in the filtered plating solution, which was measured by an ICP atomic emission spectrometer, and plotted against time at each keeping temperature, with and without a rare earth impurity precipitate.

The plating solution in a necessary amount for ICP atomic emission spectroscopy was taken at constant intervals, and the concentration of Nd impurity in the plating solution was measured in the same manner as in Reference Example 1 by an ICP atomic emission spectrometer. The results are shown in Table 2 and FIG. 4. These results indicate that at both solution temperatures of 60° C. and 70° C., the amount of Nd impurity was reduced more in the plating solution to which the above precipitate was added than in the plating solution to which the precipitate was not added, in the same period of time.

TABLE 2

| Temperature | Amount (ppm) of Nd Impurity at Each Lapsed Time | | | | |
|---|---|---|---|---|---|
| of Solution | 0 hr | 24 hr | 48 hr | 72 hr | 96 hr |
| 60° C. | 576 | 575 | 529 | 450 | 374 |
| 60° C.(1) | 576 | 503 | 413 | 334 | 279 |
| 70° C. | 576 | 553 | 443 | 346 | 284 |
| 70° C.(1) | 576 | 370 | 233 | 196 | 157 |

Note:
(1)The precipitate were added.

Reference Example 5

A pH-4.5 plating solution having a composition comprising 250 g/L of nickel sulfate, 50 g/L of nickel chloride, and 45 g/L of boric acid was heated to 50° C., and used in the nickel electroplating of several types of sintered R—Fe—B magnets in the same composition range as in Reference Example 1. ICP atomic emission spectroscopy revealed that in the nickel-electroplating solution after used in plating for several days, the Nd impurity was 544 ppm.

The above plating solution was dispensed 3 liters each to two beakers, and heated to 90° C. In one beaker, water was supplemented during heating to keep the concentration of the plating solution from changing (decreasing). In the other beaker, water was not added during heating, so that the amount of plating solution was reduced to half (solution concentration became 2 times) in about 24 hours. Thereafter, water was supplemented to keep half an amount of the plating solution. Under both conditions, stirring was conducted with a magnet stirrer during heating as in Reference Example 1.

The plating solution in a necessary amount for ICP atomic emission spectroscopy was taken at constant intervals, and the concentration of Nd impurity was measured by an ICP atomic emission spectrometer in the same manner as in Reference Example 1. The analysis results are shown in Table 3 and FIG. 5.

TABLE 3

| Temperature | Amount (ppm) of Nd Impurity at Each Lapsed Time | | | | |
|---|---|---|---|---|---|
| of Solution | 0 hr | 24 hr | 48 hr | 72 hr | 96 hr |
| 90° C. | 544 | 154 | 84 | 69 | 59 |
| 90° C.(1) | 544 | 52 | 49 | 42 | 48 |

Note:
(1)Concentrated to 2 times.

Figure 5:
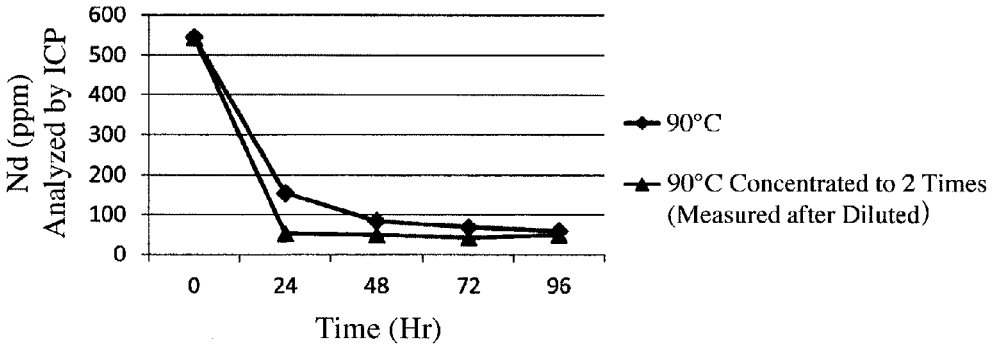
FIG. 5 is a graph showing the amount of Nd as a rare earth impurity in the filtered plating solution, which was measured by an ICP atomic emission spectrometer, and plotted against time at each concentration of the plating solution.

As is clear from FIG. 5, when water was added to keep the amount of the plating solution, the amount of the impurity gradually decreased to 59 ppm in 96 hours. On the other hand, when the amount of the plating solution was not kept constant (water was not added), the amount of Nd impurity decreased to 52 ppm in 24 hours. When the amount of the plating solution was not kept constant (solution concentration: 2 times), the plating solution was diluted to 2 times to measure the concentration of Nd impurity. The above results indicate that higher effects of decreasing rare earth impurities are obtained at a higher concentration of a plating solution.

Reference Example 6

The plating solution containing rare earth impurities (Nd impurity: 544 ppm), which was used in plating for several days in Reference Example 5, was dispensed 3 liters each to five beakers. 1 g/L of the same precipitate as used in Reference Example 3 was added to 4 beakers, and no precipitate was added to a remaining beaker. Each plating solution was kept at 90° C. while stirring as in Reference Example 1. Water was not added until the amount of the plating solution became half (substantially half after 24-hour heating). Thereafter, water was added to keep the concentration of the plating solution as high as 2 times the initial concentration. In this period, stirring was conducted as in Reference Example 1.

The concentration of Nd impurity in each plating solution was measured by an ICP atomic emission spectrometer. When the precipitate was not added, the concentration of Nd impurity was 52 ppm after heating for 24 hours. In four plating solutions to which the precipitate was added, the concentration of Nd impurity was 32 ppm, 56 ppm, 52 ppm, and 61 ppm, respectively, after heating for 24 hours. It was thus found that concentration to 2 times provided the same impurity-decreasing effects regardless of whether or not the precipitate was added. The concentration of Nd impurity was measured with the plating solution diluted to 2 times.

Reference Example 7

The plating solution containing rare earth impurities (the concentration of Nd impurity: 576 ppm), which was used in plating for several days in Reference Example 2, was charged into a 3-liter beaker, and kept at 90° C. without stirring in the same manner as in Reference Example 2. To prevent the concentration of the plating solution from changing, water was added to keep the amount of the plating solution. The plating solution was taken at constant intervals, and the amount of impurities was measured by an ICP atomic emission spectrometer as in Reference Example 1.

The concentration of Nd impurity was reduced to 137 ppm in 24 hours, 73 ppm in 72 hours, and 63 ppm in 96 hours, similarly to Reference Example 2. As is clear from above, the influence of stirring was not significant when the amount of the plating solution was about 3 liters. However, because the amount of a plating solution in a usual plating bath is several tens to 100 times or more, stirring is preferable to achieve a uniform solution temperature, for example, when rare earth impurities are removed from a plating solution in an amount of several hundreds of liters or more.

Reference Example 8

The same used plating solution as the plating solution used in plating for several days in Reference Example 1 was prepared. ICP atomic emission spectroscopy revealed that this used plating solution contained 500 ppm of Nd, 19 ppm of Fe, and 3 ppm of Cu.

This used plating solution was heated to 90° C. as in Reference Example 1, and taken in a necessary amount for ICP atomic emission spectroscopy after 24 hours and 96 hours, respectively. ICP atomic emission spectroscopy revealed that the plating solution contained 100 ppm of Nd, 3 ppm of Fe and less than a detectable limit of Cu after 24 hours, and 50 ppm of Nd, 1 ppm of Fe and less than a detectable limit of Cu after 96 hours. It was confirmed that by a heating treatment, not only rare earth impurities but also Fe and Cu could be removed from the used plating solution.

Reference Example 9

A plating solution having a composition comprising 250 g/L of nickel sulfate, 50 g/L of nickel chloride and 45 g/L of boric acid, and having pH of 4.5 was heated to 50° C., to carry out nickel electroplating on sintered R—Fe—B magnets in the same composition range as in Reference Example 1 (magnets used in each batch had the same composition). Analysis revealed that the nickel-electroplating solution after used in plating for several days contained 581 ppm of Nd impurity.

(i) First Heating Treatment

The above plating solution was charged into a 3-liter beaker, and heated to 90° C. while stirring with a magnet stirrer. During heating, water was supplemented to keep the concentration of the plating solution constant, and the amount (concentration) of Nd impurity in the plating solution was analyzed after 1 hour, 3 hours, 6 hours, 12 hours and 24 hours, respectively, by an ICP atomic emission spectrometer as in Reference Example 1. After 24 hours, the stirrer was stopped to sediment a precipitate, and the plating solution was taken away from the beaker, with the precipitate left to remain on the beaker bottom.

(ii) Second Heating Treatment

Figure 6:
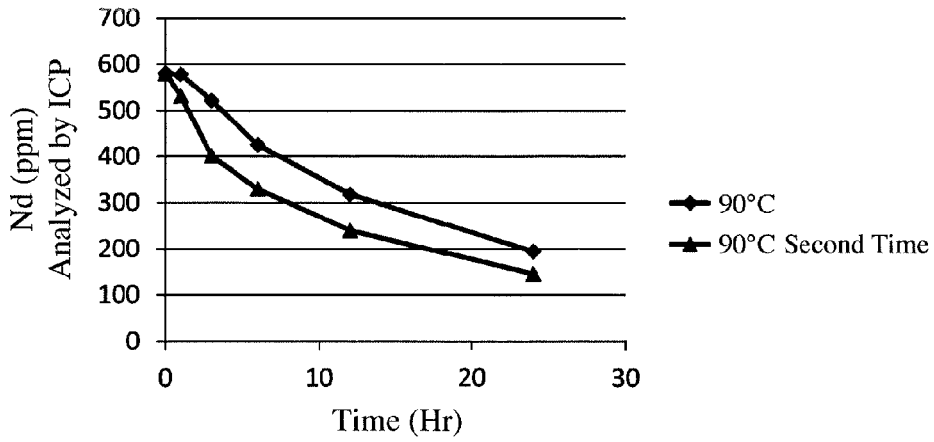
FIG. 6 is a graph showing the amount of Nd as a rare earth impurity in the filtered plating solution, which was measured by an ICP atomic emission spectrometer, and plotted against time.

The nickel-electroplating solution used in plating in this Reference Example (containing 581 ppm of Nd impurity) was charged into the beaker with the above precipitate remaining, and heated to 90° C. while stirring with a magnet stirrer. During heating, water was supplemented to keep the concentration of the plating solution constant, and the concentration of Nd impurity in the plating solution was measured by an ICP atomic emission spectrometer after 1 hour, 3 hours, 6 hours, 12 hours and 24 hours, respectively, in the same manner as in Reference Example 1. The analysis results of the Nd impurity are shown in Table 4 and FIG. 6, together with those of the first heating treatment (before leaving the precipitate).

TABLE 4

| Temperature of Solution | Amount (ppm) of Nd Impurity at Each Lapsed Time | | | | | |
|---|---|---|---|---|---|---|
| | 0 hr | 1 hr | 3 hr | 6 hr | 12 hr | 24 hr |
| 90° C. (First Time) | 581 | 578 | 521 | 425 | 318 | 195 |
| 90° C. (Second Time) | 581 | 532 | 400 | 329 | 241 | 146 |

In the first heating treatment (90° C.), remarkable decrease in the Nd impurity (precipitation) was confirmed after about 3 hours. In the second heating treatment (90° C.) with the precipitate remaining in the beaker, the Nd impurity decreased more rapidly, the precipitation of the impurity starting after 1 hour. The second heating treatment with the remaining precipitate provided the same results as in a case where the precipitate of Reference Example 4 was added. The repeated removal of rare earth impurities from a nickel-electroplating solution using a precipitate-remaining beaker corresponds to a case where a previously removed precipitate is added, and a case where a new nickel-electroplating solution is added with a sedimented precipitate remaining, to remove rare earth impurities again after used in plating.

Reference Example 10

(i) First Heating Treatment

The plating solution used in plating for several days in Reference Example 9 (Nd impurity: 581 ppm) was charged into a 3-liter beaker, and heated to 90° C. Water was not supplemented until the concentration of the plating solution became 2 times (half in amount) by heating, and water was then supplemented to keep the amount of the solution. The amount (concentration) of Nd impurity in the plating solution was analyzed by an ICP atomic emission spectrometer after 1 hour, 3 hours, 6 hours, 12 hours and 24 hours, respectively, as in Reference Example 1. For analysis, the plating solution was diluted 2 times to have the same concentration as before heating. After 24 hours, the stirrer was stopped to sediment a precipitate, and the plating solution was taken away from the beaker, with the precipitate remaining on the beaker bottom.

(ii) Second Heating Treatment

Figure 7:
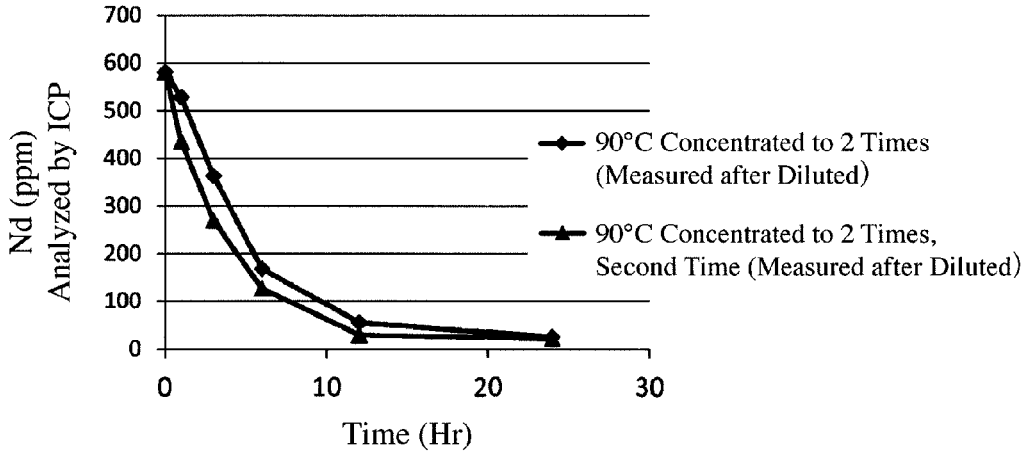
FIG. 7 is a graph showing the amount of Nd as a rare earth impurity in the filtered plating solution, which was measured by an ICP atomic emission spectrometer, and plotted against time.

The same nickel-electroplating solution used in plating (containing 581 ppm of Nd impurity) as in Reference Example 9 was charged into a beaker with the precipitate remaining, and heated to 90° C. Water was not added until the concentration of the plating solution became 2 times (half in amount) by heating, and water was then supplemented to keep the amount of the solution. The concentration of Nd impurity in the plating solution was analyzed by an ICP atomic emission spectrometer, after 1 hour, 3 hours, 6 hours, 12 hours and 24 hours, respectively, in the same manner as in Reference Example 1. For analysis, the plating solution was diluted (2 times) to have the same concentration as before heating. The analysis results of the Nd impurity are shown in Table 5 and FIG. 7, together with those of the first heating treatment (before leaving the precipitate).

TABLE 5

| Temperature of Solution | Amount (ppm) of Nd Impurity at Each Lapsed Time | | | | | |
|---|---|---|---|---|---|---|
| | 0 hr | 1 hr | 3 hr | 6 hr | 12 hr | 24 hr |
| 90° C. (1) (First Time) | 581 | 529 | 362 | 168 | 55 | 25 |
| 90° C. (1) (Second Time) | 581 | 435 | 269 | 127 | 29 | 22 |

Note:
(1) Concentrated to 2 times.

In the first heating treatment (90° C.) conducted without supplementing water until the amount of the plating solution became half, decrease in the Nd impurity was observed after 1 hour, and the Nd impurity decreased to 168 ppm after 6 hours, and to about 50 ppm after 12 hours. In the second heating treatment (90° C.) conducted without supplementing water to a beaker with the precipitate remaining, the Nd impurity decreased more rapidly before 24 hours passed, and to 50 ppm or less in 12 hours. The second heating treatment with the precipitate remaining provided the same results as when the precipitate of Reference Example 4 was added.

Thus, precipitation already starts 1 hour after heating for concentration, and filtration or sedimentation can decrease the precipitate to 200 ppm or less after 6 hours. Namely, concentration by heating enables continuous plating by decreasing the Nd impurity to 200 ppm or less in a short period of time.

Further, by a 3-hour treatment, it can be reduced from 581 ppm to 362 ppm (to 269 ppm, when the previously obtained precipitate remains). Such plating solution, in which the concentration of Nd impurity is 362 ppm (269 ppm), can be used for a plating treatment for a certain period of time, despite a shorter plating time (treatment amount) than when a new plating solution is used, or when the impurity is reduced to 200 ppm or less.

When the previously obtained precipitate remains while heating for concentration, a treatment for only about 1 hour can reduce 581 ppm to 435 ppm, enabling use for a certain period of time, despite a shorter plating time than a 3-hour treatment.

Reference Example 11

Using the plating apparatus shown in FIG. 1, a plating solution having a composition comprising 250 g/L of nickel sulfate, 45 g/L of nickel chloride and 45 g/L of boric acid, and having pH of 4.5 was heated to 50° C. to carry out barrel-type nickel electroplating for several days, on a combination of several types of sintered R—Fe—B magnets (having different compositions within the same composition range as in Reference Example 1). Analysis revealed that the plating solution with rare earth impurities accumulated after the plating treatment had a composition comprising 250 g/L of nickel sulfate, 45 g/L of nickel chloride, and 45 g/L of boric acid, the concentration of Nd impurity being 600 ppm.

The naked-eye observation of the appearances of magnets after a final stage of the above barrel-type plating (Nd impurity: about 600 ppm) revealed that the plating suffered double plating and peeling at a proportion of 1% or less.

500 L of the entire nickel-electroplating solution kept at 90° C. was sent from the plating bath 1 to the preliminary bath 8, while stirring with the stirring blades 9. The stirring blades 9 and the heater 10 were stopped after 24 hours. With the valve 16 closed, and the valves 11, 14, 15 open, the pump 12 was operated to return the plating solution to the plating bath 1 through the filtering equipment 13. In the plating solution returned to the plating bath 1, the concentration of Nd impurity was 50 ppm.

Though the plating solution was returned from the preliminary bath 8 to the plating bath 1 while carrying out filtration, with the valve 16 closed, and the valves 11, 14, 15 open, in Reference Examples above, the pump 12 may be operated with the valve 16 closed, and the valves 11, 14, 15 open, to circulate the plating solution through the preliminary bath 8 via the filtering equipment 13 while carrying out filtration, and the plating solution may be returned from the preliminary bath 8 to the plating bath 1 with the filtering equipment 13 replaced by a new one, with the valve 16 closed, and the valves 11, 14, 15 open.

Reference Example 12

With respect to the plating solution with rare earth impurities removed in the preliminary bath 8 and returned to the plating bath 1 by the method of Reference Example 11, analysis of its component indicates that the proportions of nickel sulfate, nickel chloride and boric acid were substantially unchanged, with only a metallic nickel component decreased 0.2%.

The plating solution after this heating treatment was adjusted to have the composition and pH (4.5) before rare earth impurities were removed (before the heating treatment), and a proper amount of a pit inhibitor was added. The adjusted plating solution was heated to 50° C., to carry out barrel-type electroplating on sintered R—Fe—B magnets. The resultant plating film did not suffer double plating and peeling caused by insufficient adhesion of the plating film. It was thus confirmed that the nickel-electroplating solution with Nd impurity removed as a precipitate for reduced amounts of rare earth impurities is sufficiently usable in an industrial-scale mass production.

Example 1

A plating solution having a composition comprising 250 g/L of nickel sulfate, 50 g/L of nickel chloride and 45 g/L of boric acid, and having pH of 4.5 was heated to 50° C., to carry out nickel electroplating on sintered R—Fe—B magnets within the same composition range as in Reference Example 1. After plating for several days, Nd impurity in the nickel-electroplating solution was 320 ppm.

The above plating solution was charged into a 3-liter beaker and heated to 60° C. The plating solution in a necessary amount for ICP atomic emission spectroscopy was taken after 48 hours, 96 hours and 144 hours, respectively. After the plating solution was taken after 144 hours, 1 g/L of neodymium oxide ($Nd_2O_3$) was added to the plating solution, whose temperature was kept at 60° C. 168 hours after starting heating, the plating solution was taken, and finally subjected to a heating treatment until 240 hours. While stirring by a magnet stirrer during heating, water was supplemented to keep the concentration of the plating solution constant. The heat-treated plating solution was filtered by a filter paper, and the amount (concentration) of Nd impurity in the plating solution was analyzed by a ICP atomic emission spectrometer. The results are shown in Table 6.

TABLE 6

| Temperature | Amount (ppm) of Nd Impurity at Each Lapsed Time | | | | | |
|---|---|---|---|---|---|---|
| of Solution | 0 hr | 48 hr | 96 hr | 144 hr | 168 hr(1) | 240 hr(1) |
| 60° C. | 320 | 320 | 315 | 310 | 40 | 40 |

Note:
(1) 1 g/L of neodymium oxide ($Nd_2O_3$) was added when 144 hours passed.

It was confirmed from the results of Example 1 that the addition of neodymium oxide ($Nd_2O_3$) to the plating solution containing rare earth impurities during heating shortened the precipitation time of rare earth impurities. It was thus confirmed that within 24 hours after adding neodymium oxide, a remarkable effect of reducing the impurity concentration appeared.

It is not clear why the precipitation of rare earth impurities is accelerated by adding a rare earth compound to a plating solution containing rare earth impurities. However, because the accelerated precipitation of rare earth impurities is confirmed in Reference Example 4, in which a precipitate was added, and in Reference Example 9, in which a precipitate remained in the plating solution to remove rare earth impurities, and because EDX analysis indicates that precipitates generated by these heating treatments contained Nd, Pr, Dy and oxygen, it may be presumed that the addition of neodymium oxide accelerates the precipitation of rare earth impurities, like the addition of the above precipitates. It is considered that because the plating solution after the plating treatment contained small amounts of rare earth impurities, the amount of Nd impurity was less reduced in Example 1 than in Reference Example 2 (heating to 60° C.), until a rare earth compound (neodymium oxide) was added (until 144 hours passed from the start of heating).

Though neodymium oxide was added after the nickel-electroplating solution containing rare earth impurities was kept at 60° C. for a certain period of time in Example above, it has been confirmed that the same effects can be obtained even if neodymium oxide is added before or during heating.

The effects of reducing impurities such as Nd, Pr and Dy were confirmed by Reference Examples and Example above, and it may be presumed that Tb and other rare earth impurities can also be decreased.

EFFECT OF THE INVENTION

According to the present invention, rare earth impurities can be removed from a nickel-electroplating solution relatively easily and efficiently, without using complicated steps and special agents, thereby enabling the electroplating of nickel particularly on sintered R—Fe—B magnets with stable quality and low cost.

The present invention is industrially useful, because plating-defects-causing rare earth impurities dissolved in a nickel-electroplating solution during plating rare earth magnets can be removed from the plating solution efficiently.

What is claimed is:

1. A method for removing rare earth impurities from a nickel-electroplating solution, consisting essentially of adding a rare earth compound to said nickel-electroplating solution containing rare earth impurities;

keeping said nickel-electroplating solution at 60° C. or higher for 6 hours or more such that some components in the nickel-electroplating solution are not precipitated, and then removing a precipitate of the rare earth impurities generated by said heating from said nickel-electroplating solution together with the added rare earth compound by sedimentation and/or filtration.

2. The method for removing rare earth impurities from a nickel-electroplating solution according to claim 1, wherein said rare earth compound is rare earth oxide.

3. The method for removing rare earth impurities from a nickel-electroplating solution according to claim 1, wherein a rare earth element constituting said rare earth compound is neodymium.

4. The method for removing rare earth impurities from a nickel-electroplating solution according to claim 1, wherein said nickel-electroplating solution is stirred while heating.

5. The method for removing rare earth impurities from a nickel-electroplating solution according to claim 4, wherein the stirring of the solution is achieved by air, rotating stirring blades, or circulation by a pump.

6. The method for removing rare earth impurities from a nickel-electroplating solution according to claim 1, wherein the adding is by adding the rare earth compound in the form of powder, or after being stirred in water, or by adding the rare earth compound to an aqueous acid solution which is then charged into the nickel-electroplating solution.

7. The method for removing rare earth impurities from a nickel-electroplating solution according to claim 1, wherein the rare earth compound is at least one selected from a rare earth oxide, a rare earth hydroxide, a rare earth salt and a rare earth sulfate.

* * * * *